US005152351A

United States Patent [19]

Rieger

[11] Patent Number: 5,152,351

[45] Date of Patent: Oct. 6, 1992

[54] PROTECTIVE ARRANGEMENT FOR A PISTON ROD OF A HYDRAULIC CYLINDER

[75] Inventor: Mario Rieger, Frieberg, Fed. Rep. of Germany

[73] Assignee: Dr. Ing. h.c.F. Porsche AG, Fed. Rep. of Germany

[21] Appl. No.: 672,426

[22] Filed: Mar. 20, 1991

[30] Foreign Application Priority Data

Mar. 30, 1990 [DE] Fed. Rep. of Germany ..... 4010225

[51] Int. Cl.[5] ..... E02F 9/24; F15B 15/20

[52] U.S. Cl. ..... 172/813; 92/53; 172/508

[58] Field of Search ..... 414/695.5; 92/23, 51, 92/52, 53, 169.1; 172/466, 508, 813, 830, 831; 37/236, DIG. 7, DIGS. 9-11

[56] References Cited

U.S. PATENT DOCUMENTS

| | | | |
|---|---|---|---|
| 2,730,823 | 1/1956 | Cassidy | 172/813 X |
| 2,983,059 | 5/1961 | Skromme | 172/813 |
| 3,883,126 | 5/1975 | Nicholls | 267/64.12 |
| 3,982,648 | 9/1976 | Luedtke et al. | 92/23 X |
| 3,997,986 | 12/1976 | Black et al. | 37/8 |
| 4,074,769 | 2/1978 | Frisbee | 172/813 |
| 4,936,193 | 6/1990 | Stoll | 92/53 X |

FOREIGN PATENT DOCUMENTS

| | | | |
|---|---|---|---|
| 0048362 | 3/1982 | European Pat. Off. . | |
| 1601715 | 8/1970 | Fed. Rep. of Germany . | |
| 3731734 | 4/1989 | Fed. Rep. of Germany . | |
| 3803964 | 8/1989 | Fed. Rep. of Germany . | |
| 13587 | of 1897 | United Kingdom | 92/52 |
| 770866 | 3/1957 | United Kingdom . | |

*Primary Examiner*—Randolph A. Reese
*Assistant Examiner*—Jeffrey L. Thompson
*Attorney, Agent, or Firm*—Evenson, Wands, Edwards, Lenahan McKeown

[57] ABSTRACT

A protective arrangement is described for a piston rod of an excavator hydraulic cylinder is arranged between a vehicle frame and a scraper blade to serve as a working cylinder for lifting and lowering. For protecting the exposed piston rod, a shell-type protective sleeve is supported by way of a stationary slide ring while resting on the latter, and encloses the piston rod from above in a protective manner during the working operation.

12 Claims, 2 Drawing Sheets

PROTECTIVE ARRANGEMENT FOR A PISTON ROD OF A HYDRAULIC CYLINDER

BACKGROUND AND SUMMARY OF THE INVENTION

The present invention relates to a protective arrangement for a piston rod of an excavator hydraulic cylinder and, more particularly, to a protective arrangement in the form of a shell-type protective sleeve fastened to a coupling lug of the piston rod. The protective sleeve is supported on the cylinder housing by a stationary slide ring.

German Patent Document DE-A 37 31 734 describes a protective arrangement of a hydraulic cylinder of a utility vehicle. The arrangement comprises a piston rod covering which, corresponding to the working movements of the hydraulic cylinder or the moving-in and moving-out movements of the piston rod, can be correspondingly displaced with it. A guiding on the cylinder housing for the displacing takes place by way of a flat guide on both sides of the covering constructed has a half-shell. Such a guided displaceable covering, because of the robust operation of utility vehicles, is subjected to a relatively high susceptibility to disturbances since even minor deformations of the covering as a result of outside influences may lead to a jamming. Thus, a functioning of the hydraulic cylinder cannot be fully ensured.

It is an object of the present invention to provide an improved protective arrangement for a piston rod of a hydraulic cylinder which has a sturdy construction and ensures protection even with the effect of outside influences.

This object has been achieved in accordance with the present invention by the provision of a shell-type protective sleeve fastened to the coupling lug of a piston rod of a hydraulic cylinder. The protective sleeve is supported on the cylinder housing by way of a stationary slide ring while resting upon it and encloses the exposed piston rod in a protective manner partially from above.

Principal advantages achieved by the invention are that the shell-type protective sleeve is guided on a slide ring of the cylinder housing, and special flat guides of the type described in German Patent DE-A 37 31 734 are not necessary. Thus, in the case of a deformation of the protective sleeve, no impairment takes place of the functioning of the hydraulic cylinder. The slide ring is preferably made elastically from a plastic material and, by way of a tightening strap, is held on the cylinder housing and thus can by mounted and exchanged in a simple manner.

The protective sleeve of the present invention can be displaced freely on the slide ring corresponding to the working movements of the hydraulic cylinder. This sleeve is subjected to no special tolerance so that, even if the sleeve is damaged, its influence on the hydraulic cylinder and a protective function remains ensured.

BRIEF DESCRIPTION OF THE DRAWINGS

These and other objects, features and advantages of the present invention will become more apparent from the following detailed description of a contemplated preferred embodiment when taken in conjunction with the accompanying drawing wherein.

DETAILED DESCRIPTION OF THE DRAWINGS

Figure 1:
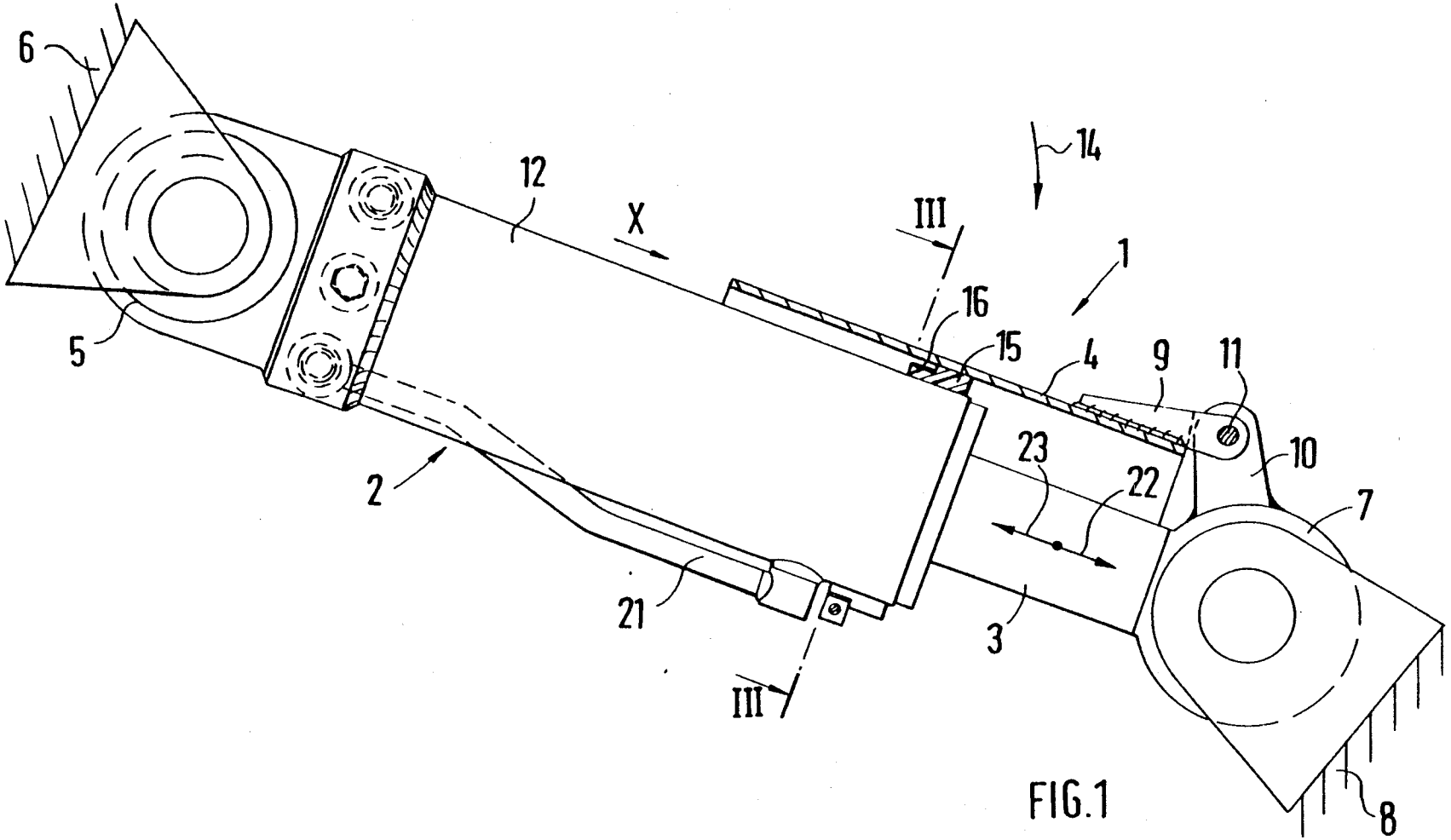
FIG. 1 is a side view of a hydraulic cylinder with a shell-type protective sleeve in accordance with the present invention.

A protective arrangement designated generally by the numeral 1 for a hydraulic cylinder 2 comprises essentially a shell-type protective sleeve 4 which partially covers the piston rod 3 of the hydraulic cylinder. By way of its one bearing lug 5 on the housing side, the hydraulic cylinder 2 is hinged to a vehicle body 6 and, by way of its rod-side bearing lug 7, the hydraulic cylinder 2 is hinged to a blade 8 or a similar working apparatus.

The shell-type protective sleeve 4 is fixedly connected with a holder 9 which, in turn, can be swivelled around a horizontal axis 11 between legs 10 of the bearing lug 7. The protective sleeve 4 encloses an area of the cylinder housing 12 as well as of the piston rod 3 which is exposed during working movements. The rod 3 is mainly protected from above, that is, against outside influences acting in the direction of the arrow 14.

Figure 2:
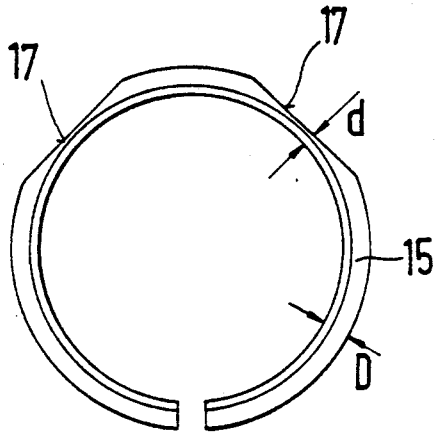
FIG. 2 is a view in the direction of the arrow X of a slide ring held on the cylinder housing.
Figure 3:
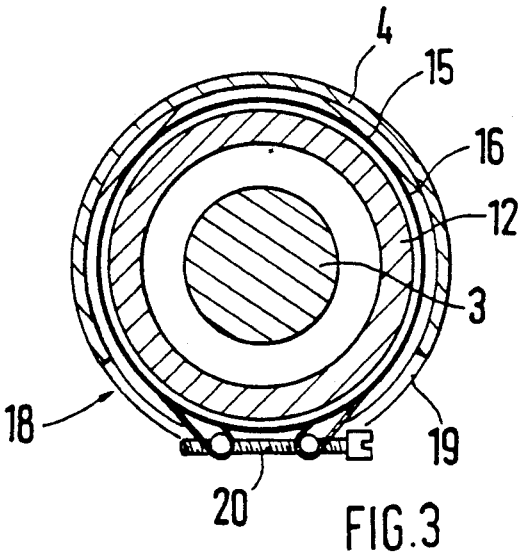
FIG. 3 is a sectional view along line III—III of FIG. 1.

The protective sleeve 4 is slidably supported and guided on a slide ring 15 of the cylinder housing 12. This slide ring 15 consists of an elastic plastic material and is clamped to the housing 12 by a tightening strap as shown in detail in FIG. 3. As seen in FIG. 2, the slide ring 15 has tangential slopes 17 on its circumference which render the ring 15 flexible and reduce the friction between the protective sleeve 4 and the slide ring 15.

In the lower area 18 of the protective arrangement 1, the shell-type protective sleeve 4 has a continuous slot 19 which forms a clearance for the screw 20 of the tightening strap 16 and for a pressure line 21 of the hydraulic cylinder 2.

When the piston rod 3 moves in and out in the directions indicated by arrows 22, 23, the protective sleeve 4 slides on the slide ring 15 and keeps the sensitive surface of the piston rod 3 over the whole working range protected from objects such as rocks or the like, falling from above in the direction of the arrow 14.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A protective arrangement for a piston rod of a hydraulic cylinder arranged between a frame and a working apparatus, comprising a shell-type protective sleeve pivotally fastened at one end thereof to a coupling lug of the piston rod and supported on the other end thereof by a stationary slide ring supported on the cylinder housing, said sleeve being configured to extend substantially around the circumference of the rod and to define a narrow longitudinal slot in the lower area thereof said pivotal fastening allowing said sleeve to pivot with respect to the slide ring to prevent jamming of the sleeve as a result of outside influences.

2. The arrangement according to claim 1, wherein the protective sleeve comprises a tube element partially surrounding the cylinder housing and having in its lower area, a longitudinal clearance slot.

3. The arrangement according to claim 2, wherein a holder fixedly connected to the protective sleeve is pivotally connected to the coupling lug so that the holder can be swivelled between legs on the lug around a horizontal axis.

4. The arrangement according to claim 1, wherein the slide ring comprises a plastic material and is fixed to the cylinder housing via a tightening strap.

5. The arrangement according to claim 4, wherein a holder fixedly connected to the protective sleeve is pivotally connected to the coupling lug so that the holder can be swivelled between legs on the lug around a horizontal axis.

6. The arrangement according to claim 5, wherein the protective sleeve comprises a tube element partially surrounding the cylinder housing and having in its lower area, a longitudinal clearance slot.

7. The arrangement according to claim 1, wherein the slide ring has tangential slopes distributed over its circumference, which slopes have a smaller wall thickness than the remaining wall thickness of the ring.

8. The arrangement according to claim 7, wherein a holder fixedly connected to the protective sleeve is pivotally connected to the coupling lug so that the holder can be swivelled between legs on the lug around a horizontal axis.

9. The arrangement according to claim 8, wherein the protective sleeve comprises a tube element partially surrounding the cylinder housing and having in its lower area, a longitudinal clearance slot.

10. The arrangement according to claim 9, wherein the slide ring comprises a plastic material and is fixed to the cylinder housing via a tightening strap.

11. An arrangement according to claim 1, wherein the protective sleeve is held with respect to the slide ring so that it can be pivoted about a stationary axis of the coupling lug, and the axis is formed between projecting legs of the coupling lug and a holder connected with the protective sleeve.

12. An arrangement according to claim 1, wherein the protective sleeve consists of a tube element partially surrounding the cylinder housing, the longitudinal slot of this tube element extending at the level of the lower boundary plane of the piston rod.

* * * * *